US010396461B2

(12) United States Patent
Kasemodel et al.

(10) Patent No.: US 10,396,461 B2
(45) Date of Patent: Aug. 27, 2019

(54) LOW PROFILE, ULTRA-WIDE BAND, LOW FREQUENCY MODULAR PHASED ARRAY ANTENNA WITH COINCIDENT PHASE CENTER

(71) Applicant: Raytheon Company, Waltham, MA (US)

(72) Inventors: Justin A. Kasemodel, McKinney, TX (US); James M. Irion, II, Allen, TX (US); Brian W. Johansen, McKinney, TX (US); Justin E. Stroup, Anna, TX (US)

(73) Assignee: RAYTHEON COMPANY, Waltham, MA (US)

( * ) Notice: Subject to any disclaimer, the term of this patent is extended or adjusted under 35 U.S.C. 154(b) by 376 days.

(21) Appl. No.: 15/246,015

(22) Filed: Aug. 24, 2016

(65) Prior Publication Data

US 2018/0062262 A1 Mar. 1, 2018

(51) Int. Cl.

| | |
|---|---|
| ***H01Q 7/08*** | (2006.01) |
| ***H01Q 1/48*** | (2006.01) |
| ***H01Q 21/24*** | (2006.01) |
| ***H01Q 15/00*** | (2006.01) |
| ***H01Q 21/00*** | (2006.01) |
| ***H01Q 21/26*** | (2006.01) |
| *H01Q 7/06* | (2006.01) |

(52) U.S. Cl.

CPC ..... *H01Q 7/08* (2013.01); *H01Q 1/48* (2013.01); *H01Q 15/0086* (2013.01); *H01Q 21/0025* (2013.01); *H01Q 21/24* (2013.01); *H01Q 21/26* (2013.01); *H01Q 7/06* (2013.01)

(58) Field of Classification Search

CPC ..... H01Q 7/08; H01Q 1/48; H01Q 15/00; H01Q 21/0025; H01Q 21/24; H01Q 21/26; H01Q 7/06

USPC ..... 343/788

See application file for complete search history.

(56) References Cited

U.S. PATENT DOCUMENTS

| | | | | |
|---|---|---|---|---|
| 8,325,093 | B2 * | 12/2012 | Holland | H01P 5/10 343/700 MS |
| 9,236,652 | B2 | 1/2016 | Kasemodel | |
| 2005/0030137 | A1 | 2/2005 | McKinzie et al. | |
| 2010/0053013 | A1 | 3/2010 | Konishi et al. | |
| 2014/0009356 | A1 * | 1/2014 | Sertel | H01Q 21/0006 343/816 |
| 2014/0132473 | A1 | 5/2014 | Isom et al. | |
| 2015/0200460 | A1 | 7/2015 | Isom et al. | |

OTHER PUBLICATIONS

J. L. Volakis, et.al, "Frequency-selective surfaces to enhance performance of broad-band reconfigurable arrays," IEEE Transactions on Antennas and Propagation, Dec. 2002, vol. 50, No. 12, pp. 1716-1724.

(Continued)

*Primary Examiner* — Andrea Lindgren Baltzell
(74) *Attorney, Agent, or Firm* — Cantor Colburn LLP

(57) ABSTRACT

An antenna is provided and includes a radiator assembly extending along a first plane, a patterned ferrite layer extending along a second plane and a band stop frequency selective surface (FSS) extending along a third plane. The third plane of the band stop FSS is axially interposed between the first plane of the radiator assembly and the second plane of the patterned ferrite layer.

20 Claims, 6 Drawing Sheets

(56) References Cited

OTHER PUBLICATIONS

Dimitrios K. Papantonis et al., "Dual-Polarized Tightly Coupled Array With Substrate Loading", IEEE Antennas and Wireless Propagation Letters, vol. 15, Feb. 19, 2016, pp. 325-328, XP011600171, ISSN: 1536-1225, DOI:10.1109/LAWP.2015.2443725 [retrieved on Feb. 19, 2016], Abstract; figures 1, 2, 7a, 7b, p. 1-p. 1.

ISR/WO, Issued Nov. 21, 2017, RAY0346PCT, PCT Application No. PCT/US2017/047502, 17 pages total.

J. M. Bell, M. F. Iskander and J. J. Lee, "Ultrawideband Hybrid EBG/Ferrite Ground Plane for Low-Profile Array Antennas," in IEEE Transactions on Antennas and Propagation, Jan. 2007, vol. 55, No. 1, pp. 4-12.

Jodie M. Bell et al., "Experimental analysis of an ultrawideband hybrid EBG/ferrite ground plane", IEEE Transactions on Instrumentation and Measurement, IEEE Service Center, Piscataway, NJ, US, vol. 58, No. 8, Aug. 1, 2009, pp. 2899-2905, XP011256702, ISSN: 0018-9456, Abstract; figures 1a, 1b, p.-p. 3.

* cited by examiner

LOW PROFILE, ULTRA-WIDE BAND, LOW FREQUENCY MODULAR PHASED ARRAY ANTENNA WITH COINCIDENT PHASE CENTER

BACKGROUND

The present disclosure relates generally to wide band array antennas and, more particularly, to a low profile, ultra-wide band, low frequency modular phased array antenna with a coincident phase center.

Ultra-wideband (also known as UWB, ultra-wide band and ultraband) is a radio technology that can use a very low energy level for short-range, high-bandwidth communications over a large portion of the radio spectrum (e.g., greater than 500 MHz or 20% of fractional bandwidth). UWB has traditional applications in non-cooperative radar imaging with recent applications targeting sensor data collection, precision locating and tracking applications.

Unlike conventional radio transmissions that transmit information by varying power levels, frequencies and/or sinusoidal wave phases, UWB transmission systems transmit information by generating radio energy at specific time intervals and by occupying a large bandwidth to thus enable pulse-position or time modulation. The information can also be modulated on UWB signals (pulses) by encoding the polarity of the pulse, its amplitude and/or by using orthogonal pulses. UWB pulses can be sent sporadically at relatively low pulse rates to support time or position modulation, but can also be sent at rates up to the inverse of the UWB pulse bandwidth.

SUMMARY

According to one embodiment, an antenna is provided and includes a radiator assembly extending along a first plane, a patterned ferrite layer extending along a second plane and a band stop frequency selective surface (FSS) extending along a third plane. The third plane of the band stop FSS is axially interposed between the first plane of the radiator assembly and the second plane of the patterned ferrite layer.

According to another embodiment, a patterned ferrite layer of an antenna with dual linear polarization and a coincident phase center is provided. The patterned ferrite layer includes ferrous material, which is arranged in line with at least the coincident phase center. The ferrous material is formed to define openings offset from the coincident phase center.

According to yet another embodiment, a phased array antenna formed of a plurality of modular antenna cells is provided. Each of the modular antenna cells includes a radiator assembly, a patterned ferrite layer, a band stop frequency selective surface (FSS) axially interposed between the radiator assembly and the patterned ferrite layer and a ground plane assembly having connective elements arranged along a perimeter thereof for connection with complementary connective elements of adjacent antenna cells.

BRIEF DESCRIPTION OF THE SEVERAL VIEWS OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Ultra-wide band (>4:1) apertures are needed for next generation multi-function radio frequency (RF) systems. They can be provided in fixed beam or active phased array antennae. The apertures need to be extremely thin and conformal to a metal back plane for platform installation. Additionally, the apertures needs to be low cost and modular such that one subarray can be assembled with another to build a resulting super array of any size. Low radiated cross polarized gain is also needed to reduce backend electronics and calibration complexity. Thus, as will be described below, an antenna offering 15:1 (e.g., 130 MHz-2 GHz) bandwidth performance over a wide frequency bandwidth and scan volume along with a low profile structure is provided. The antenna is modular and scalable to any desired size. In addition, a combination of ferrite materials and frequency selective surfaces above and below the radiator is provided to thereby enable extremely low profile low frequency performance.

Figure 1:
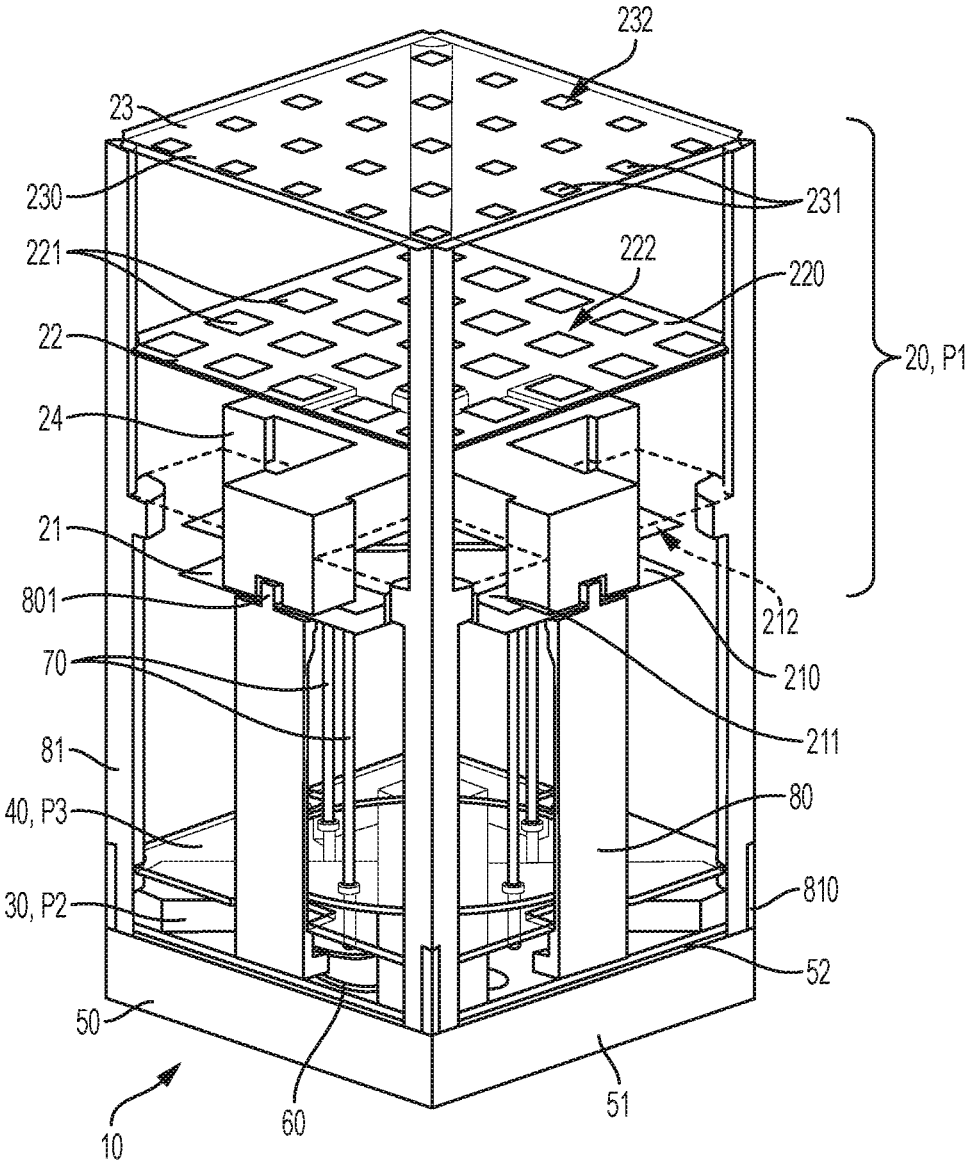
FIG. 1 is a perspective view of an antenna cell for use in a phased array antenna in accordance with embodiments.

With reference to FIG. 1, an antenna cell 10 is provided for use in a phased array antenna including a plurality of antenna cells or, more particularly, for use in a low profile, ultra-wide band, low frequency modular phased array antenna with a coincident phase center. The antenna cell 10 exhibits good to excellent cross-polarization performance that is maintained over an entire field of view (FOV). The antenna cell 10 can be deployed in an ultra-wide band (UWB) phased array antenna that provides for 15:1 bandwidth at up to a 60 degree scan angle. The antenna cell 10 is dual polarized with a coincident phase center and has a modular design at the element or subarray level to permit connection of the antenna cell 10 to adjacent antenna cells 10. The antenna cell 10 further includes feed electronics embedded inside its ground plane to reduce depth and improve thermal performance, strategically placed ferrite to reduce RF losses and weight while increasing bandwidth and at least one or more band-stop frequency selective surfaces (FSS) between its radiator and ferrite to minimize dissipative losses in the ferrite material.

In particular, the antenna cell 10 includes a radiator assembly 20 that extends along a first X-Y plane P1, a patterned ferrite layer 30 that extends along a second X-Y plane P2 and a band stop frequency selective surface (FSS) 40 that extends along a third X-Y plane P3 and is configured to minimize dissipative losses in the patterned ferrite layer 30. The third X-Y plane P3 of the band stop FSS 40 is axially interposed along a height (or Z-axis) direction between the first X-Y plane P1 of the radiator assembly 20 and the second X-Y plane P2 of the patterned ferrite layer 30. The antenna cell 10 also includes a coincident phase center 11 (see FIGS. 2-4) that will be described below. A center of a pattern of the patterned ferrite layer 30 and a corresponding center of an operable member of the band stop FSS 40 are formed and arranged in accordance with the coincident phase center 11.

The antenna cell 10 further includes a horizontal ground plane 50 and feed electronics 60. The horizontal ground plane 50 includes a support plate 51, which may be formed of aluminum or another suitable metallic material, a power divider feed printed wiring board (PWB) 52 that is disposed on an upper surface of the support plate 51 and spacers 53 (see FIG. 5). The spacers 53 are disposed on an upper surface of the power divider feed PWB 52 and support the patterned ferrite layer 30. The feed electronics 60 may be provided as electrical circuit traces running along a substantially horizontal X-Y plane defined by the horizontal ground plane 50 within the power divider feed PWB 52 and are thus at least partially embedded within the horizontal ground plane 50. Such embedding of the feed electronics 60 allows for reduced depth profile of the antenna cell 10 as a whole and may improve thermal performance. In any case, the feed electronics 60 are operably disposed to carry signals for delivery to the radiator assembly 20 by way of vertical transmission line structures 70 (to be described below), which are electrically coupled to the feed electronics 60 and the radiator assembly 20.

The radiator assembly 20 includes an aperture PWB layer 21, a first FSS superstrate structure 22, a second FSS superstrate structure 23 and a spatially engineered dielectric layer 24. In combination with one another, the various components of the radiator assembly including, in particular, the first and second FSS superstrate structures 22 and 23 and the spatially engineered dielectric layer 24, form a metamaterial wide angle impedance matching (M-WAIM) layer or structure.

Opposing surfaces of the aperture PWB layer 21 face toward and away from the band stop FSS 40, respectively. The aperture PWB layer 21 includes a wiring board substrate 210 and circuit traces 211 disposed on the wiring board substrate 210. The aperture PWB layer 21 is formed to define one or more apertures 212 that are offset from the coincident phase center 11 which is defined by symmetric combinations of all of the circuit traces 211 and apertures 212 for both poles of the antenna cell 10. In accordance with embodiments, the aperture PWB layer 21 may be formed in a pattern that is similar to that of the patterned ferrite layer 30 but at an offset angle relative to the patterned ferrite layer 30. That is, where the patterned ferrite layer 30 is provided in an X-formation as will be described below, the aperture PWB layer 21 may be formed in a crisscrossing formation disposed at a 45 degree angle relative to the X-formation.

The spatially engineered dielectric layer 24 and the M-WAIM as a whole are disposed over the surface of the aperture PWB layer 21 that faces away from the band stop FSS 40. The spatially engineered dielectric layer 24 is interposed between the aperture PWB layer 21 and the first and second FSS superstrate structures 22 and 23. With the first and second FSS superstrate structures 22 and 23 formed of a cyanate ester quartz laminate or other similar materials, the spatially engineered dielectric layer 24 may be formed of a matrix in which high dielectric inclusions are defined. For the first and second FSS superstrate structures 22 and 23, the laminate may be fabricated from several sheets which are cured together and thus provide for an impedance match to free space as well as providing for an environmental seal in some cases.

The first FSS superstrate structure 22 is disposed at a distance from the spatially engineered dielectric layer 24 and includes a body 220. As noted above, the body 220 may be formed of the cyanate ester quartz laminate or the other similar materials and has first etched conductors 221 provided on a surface thereof or within an internal structure thereof. The second FSS superstrate structure 23 is disposed at a distance from the first FSS superstrate structure 22 and includes a body 230. As noted above, the body 230 may be formed of the cyanate ester quartz laminate or the other similar materials and has second etched conductors 231 provided on a surface thereof or within an internal structure thereof. In accordance with embodiments, the first and second etched conductors 221 and 231 may each be rectangular or square and may be arranged in respective first and second matrices 222 and 232. In accordance with further embodiments, a size of each of the second etched conductors 231 may be smaller than the sizes of each of the first etched conductors 221 while a pitch of the second matrix 232 may be smaller than the pitch of the first matrix 222.

That is, the first and second FSS superstrate structures 22 and 23 may respectively include spatially varying, first and second etched conductors 221 and 231 that are configured along with the high dielectric inclusions of the spatially engineered dielectric layer 24 to provide for the greater than 10:1 bandwidth ratio or, more particularly, to provide for the 15:1 bandwidth ratio in which the antenna cell 10 is operable from 130 MHz to 2 GHz at up to 60 degrees or more of a scan angle.

The antenna cell 10 may further include the vertical transmission line structures 70, which may be provided as coaxial cables, PWB-based micro-strip and strip-line elements or other similar structures, as well as first and second feed tower members 80 and 81. The vertical transmission line structures 70 have first ends that are coupled to the feed electronics 60 and which extend through the band stop FSS 40 and second ends that are electrically coupled to the aperture PWB layer 21. Thus, as noted above, the vertical transmission line structures 70 are operably disposed to carry signals from the feed electronics 60 to the aperture PWB layer 21 of the radiator assembly 20. The first and second feed tower members 80 and 81 support various components of the radiator assembly 20 relative to at least the patterned ferrite layer 30 and the band stop FSS 40.

The first feed tower members 80 may be arranged along a perimeter of the antenna cell 10 and extend from an upper surface of the power divider feed PWB 52 of the horizontal ground plane 50, through apertures in the band stop FSS 40 and to a lower surface of the aperture PWB layer 21. The first feed tower members 80 may be bolted, soldered or otherwise adhered to the power divider feed PWB 52 and may include a bolt or snap-fit feature 801 by which the first feed tower members 80 are securely connectable with the aperture PWB layer 21 and possibly the spatially engineered dielectric layer 24 as well. The first feed tower members 80 may be formed of aluminum or another suitable metallic material and may have rectangular or other cross-sectional shapes with optional filleted end sections for greater support.

The second feed tower members 81 may be arranged at corners of the antenna cell 10 and extend from the upper surface of the support plate 51 of the horizontal ground plane 50, through the apertures 212 of the aperture PWB layer 21 and to the first and second FSS superstrate structures 22 and 23. The second feed tower members 81 may be bolted to the support plate 51 by first bolts 810 and to the second FSS superstrate structure 23 by second bolts 811 (see FIG. 8). The second feed tower members 81 may extend through through-holes 812 (see FIG. 7) defined in the first FSS superstrate structure 22 and may be bonded or adhered to sidewalls of those through-holes 812. The second feed tower members 81 may be formed of Rexolite™ or another suitable dielectric material.

With the constructions described above, the antenna cell 10 exhibits performance improvements over conventional antennae. The antenna cell 10 with the patterned ferrite layer 30, the band stop FSS 40 and the resulting coincident phase center 11 exhibits near-upper limit realized gain performance over the 15:1 bandwidth ratio.

Figure 4:
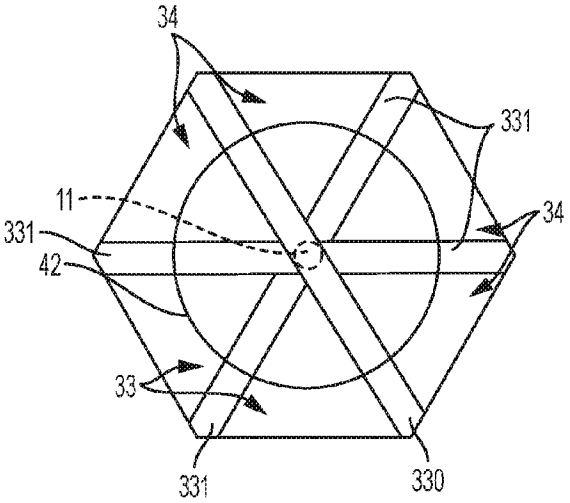
FIG. 4 is a top-down view of a patterned ferrite layer and a band stop frequency selective surface (FSS) of an antenna cell in accordance with alternative embodiments.
Figure 3:
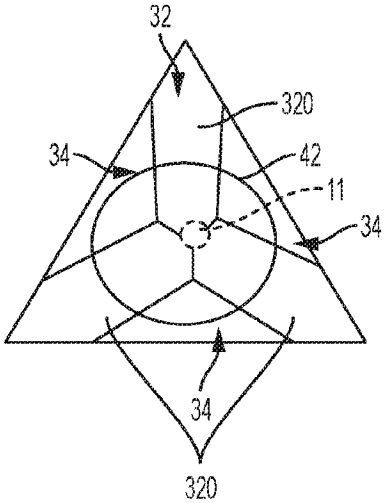
FIG. 3 is a top-down view of a patterned ferrite layer and a band stop frequency selective surface (FSS) of an antenna cell in accordance with alternative embodiments.
Figure 2:
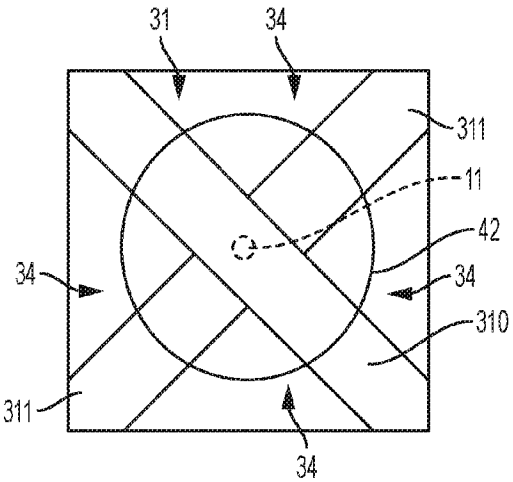
FIG. 2 is a top-down view of a patterned ferrite layer and a band stop frequency selective surface (FSS) of the antenna cell of FIG. 1 in accordance with embodiments.

With reference to FIGS. 2-4, it is noted that the antenna cell 10 is illustrated as having an exemplary rectangular or square shape in FIGS. 1 and 2 but that this shape is not required and that others are possible as long as they support modular connections of the antenna cell 10 to adjacent antenna cells 10. Thus, the antenna cell 10 can have a rectangular or square shape as shown in FIG. 2, a triangular shape as shown in FIG. 3, a hexagonal shape as shown in FIG. 4, etc., while the pattern of the patterned ferrite layer 30 and the configuration of the band stop FSS 40 may be varied for each case.

That is, in the rectangular or square case of FIG. 2, the patterned ferrite layer 30 may be provided in an X-formation 31 including a long cross member 310 extending between opposite corners of the antenna cell 10 and short transverse cross members 311 extending from sides of the long cross member 310 to the remaining corners of the antenna cell 10. The long cross member 310 and the short transverse cross members 311 may each be disposed at an acute angle relative to a perimeter of the antenna cell 10 and may be formed of a ferrous material. Here, the band stop FSS 40 may be provided as a dielectric substrate with an annular conductive element 42 suspended therein. The annular conductive element 42 may be disposed to surround the vertical transmission line structures 70 without extending radially outwardly to the apertures through which the first feed tower members 80 extend. The annular conductive element 42 has a center that is substantially coaxial with the crossing point of the X-formation 31 to thereby define the coincident phase center 11.

In the triangular case of FIG. 3, the patterned ferrite layer 30 may be provided in a Y-formation 32 including transverse members 320 that are all disposed at an acute angle relative to an antenna cell perimeter, that are all formed of a ferrous material and which extend from a central region to the corners of the triangular antenna cell. Here, again, the band stop FSS 40 may be provided as the dielectric substrate with the annular conductive element 42 suspended therein. As above, the annular conductive element 42 may be disposed to surround the vertical transmission line structures 70 without extending radially outwardly to the apertures through which the first feed tower members 80 extend and has a center that is substantially coaxial with the central region of the Y-formation 32 to thereby define the coincident phase center 11.

In the hexagonal case of FIG. 4, the patterned ferrite layer 30 may be provided in a double crossing X-formation 33 including a long cross member 330 extending between opposite corners of the hexagonal antenna cell and short transverse cross members 331 extending from sides of the long cross member 330 to the remaining corners of the hexagonal antenna cell. The long cross member 330 and the short transverse cross members 331 may each be disposed at an acute angle relative to an antenna cell perimeter and may be formed of a ferrous material. Here, again, the band stop FSS 40 may be provided as the dielectric substrate with the annular conductive element 42 suspended therein. As above, the annular conductive element 42 may be disposed to surround the vertical transmission line structures 70 without extending radially outwardly to the apertures through which the first feed tower members 80 extend and has a center that is substantially coaxial with the crossing point of the double crossing X-formation 33 to thereby define the coincident phase center 11.

In accordance with embodiments and, for each of the various potential shapes of the antenna cell and the patterned ferrite layer 30, the patterning serves to define openings or apertures 34 that are offset from the coincident phase center 11. Such openings or apertures 34 serve to reduce RF losses and to reduce an overall weight of the ferrite and the antenna cell as a whole.

With the alternative shapes of FIGS. 2-4 having been discussed non-exhaustively, it will be understood that the following descriptions will relate only to the case of the antenna cell 10 being rectangular or square (e.g., square) as shown in FIGS. 1 and 2. This is done for purposes of clarity and brevity and should not be interpreted as limiting the scope of the present disclosure in any way, shape or form.

With reference now to FIGS. 5 and 6, FIGS. 7 and 8 and FIGS. 9 and 10, an assembly process of a phased array antenna 10' (see FIG. 10) that is formed of a plurality of antenna cells 10 (hereinafter referred to interchangeably as antenna cells 10, modular antenna cells 10 and integral antenna cells 10) will be discussed. Each of the modular antenna cells 10 includes the features described above, which need not be described again, and a ground plane assembly 90. The ground plane assembly 90 surrounds the horizontal ground plane 50 and a height-wise portion of the patterned ferrite layer 30 and includes connective elements 91 that are arranged along a perimeter of the modular antenna cell 10 for connection with complementary connective elements 91 of adjacent antenna cells 10. In accordance with embodiments in which the modular antenna cells 10 are all square, the respective perimeters of each of the modular antenna cells 10 have four sides. Thus, the connective elements 91 permit connections between the ground plane assembly 90 of any one of the modular antenna cells 10 and respective ground plane assemblies 90 of adjacent modular antenna cells 10 along any or all of the four sides.

Figure 6:
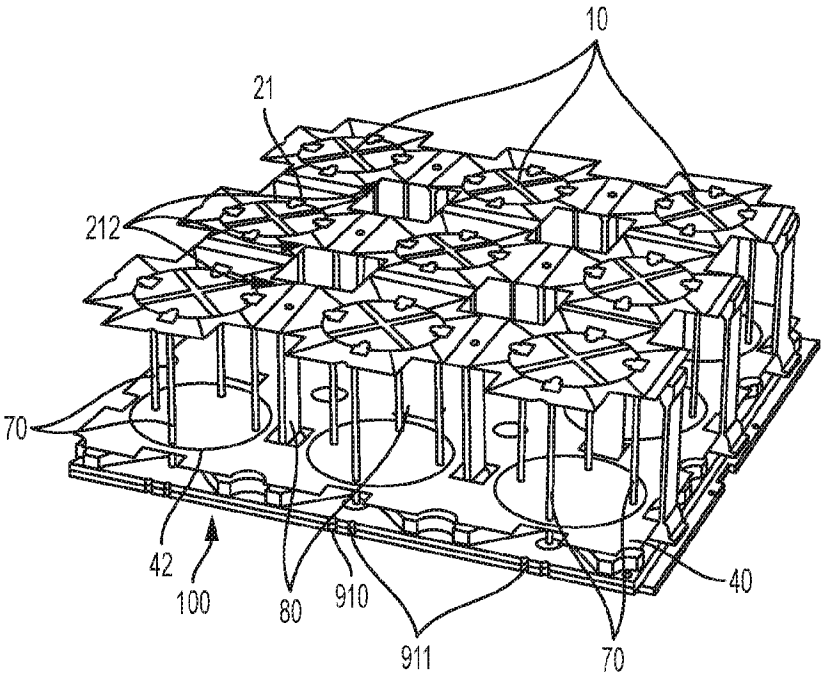
FIG. 6 is a perspective view of an assembly resulting from a late stage of an aperture super cell subassembly process showing an array of apertures positioned over the antenna ground plane and ferrite layer with intermediate band stop frequency selective surface (FSS)
Figure 5:
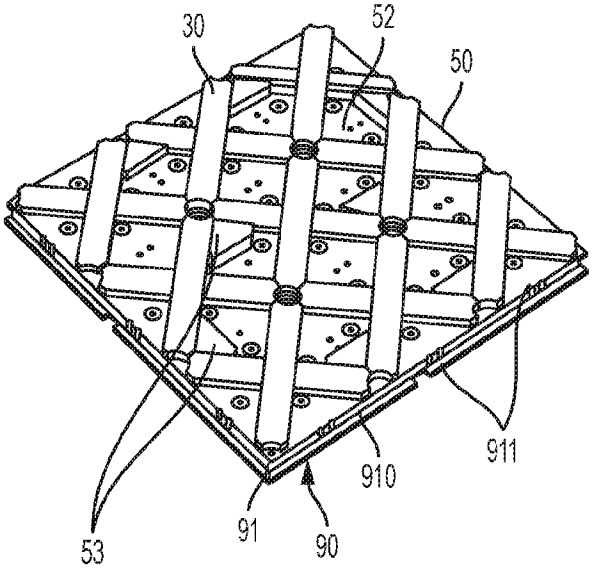
FIG. 5 is a perspective view of an assembly resulting from an initial stage of an aperture super cell subassembly process showing a ferrite layer on top of an antenna ground plane.

With reference to FIGS. 5 and 6, the assembly process may begin with initial and late stage assembly processes for assembling an aperture super cell subassembly 100 that includes nine integral antenna cells 10 arranged in a matrix. As shown in FIG. 5, the initial stage assembly process for the aperture super cell subassembly 100 may include a bonding of the power divider feed PWB 52 to the support plate 51 (see FIG. 1), a bonding of the spacers 53 to the upper surface of the power divider feed PWB 52 and a bonding of components of the patterned ferrite layer 30 (in this case, the long cross members 310 and the short transverse cross members 311) to the upper surfaces of the spacers 53. The initial stage assembly process for the aperture super cell subassembly 100 may further include a formation of the connective elements 91 around at least the perimeter of the horizontal ground plane 50. In accordance with embodiments, the connective elements 91 may include a perimetric structure 910 and connection openings 911 defined in the perimetric structure 910. As shown in FIG. 6, the late stage assembly process for the aperture super cell subassembly 100 may include a bonding of the band stop FSS 40 to the patterned ferrite layer 30, a connection of the first feed tower members 80 to the power divider feed PWB 52 and the aperture PWB layer 21 and a soldering of the vertical transmission line structures 70 to the feed electronics 60 (see FIG. 1) and the aperture PWB layer 21.

Figure 8:
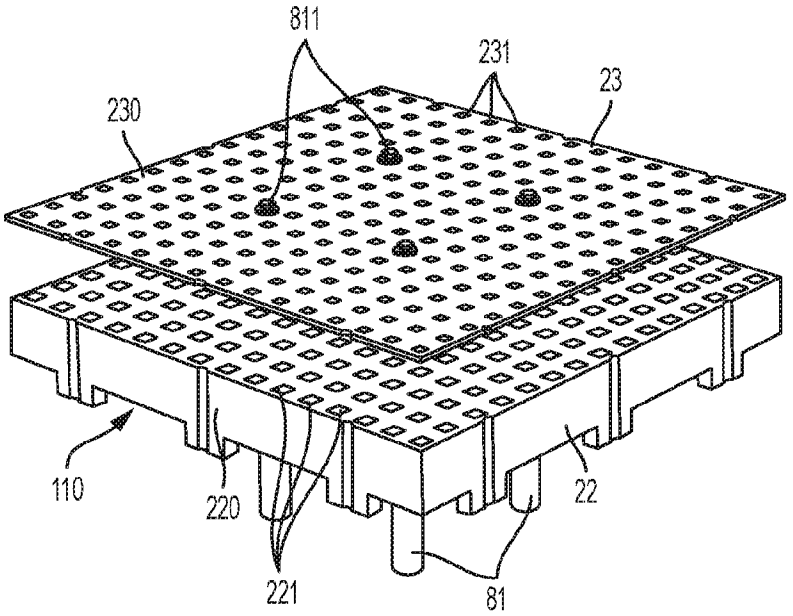
FIG. 8 is a perspective view of an assembly resulting from a late stage of a meta-material wide angle impedance matching (M-WAIM) layer super cell subassembly process.
Figure 7:
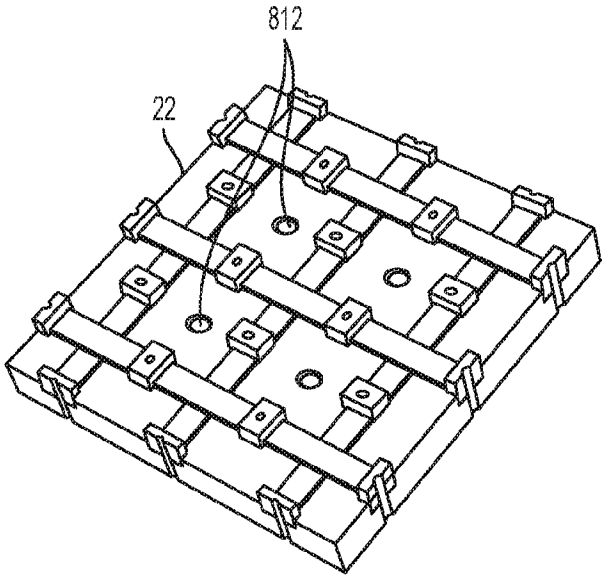
FIG. 7 is a perspective view of an assembly resulting from an initial stage of a meta-material wide angle impedance matching (M-WAIM) layer super cell subassembly process.

With reference to FIGS. 7 and 8, the assembly process may continue with initial and late stage assembly processes for assembling an M-WAIM super cell subassembly 110 that is formed and sized to fit over the nine integral antenna cells 10 of the aperture super cell assembly 100. As shown in FIG. 7, the initial stage assembly process for the M-WAIM super cell assembly 110 may include a bonding or installation of the first and second etched conductors 221 and 231 to or in the bodies 220 and 230 of the first and second FSS superstrate structures 22 and 23, respectively. As shown in FIG. 8, the late stage assembly process for the M-WAIM super cell assembly 110 may include a bonding of the second feed tower members 81 to the first FSS superstrate structure 22 at the sidewalls of the through-holes 812 and a bolting of the second feed tower members 81 to the second FSS superstrate structure 23.

Figure 9:
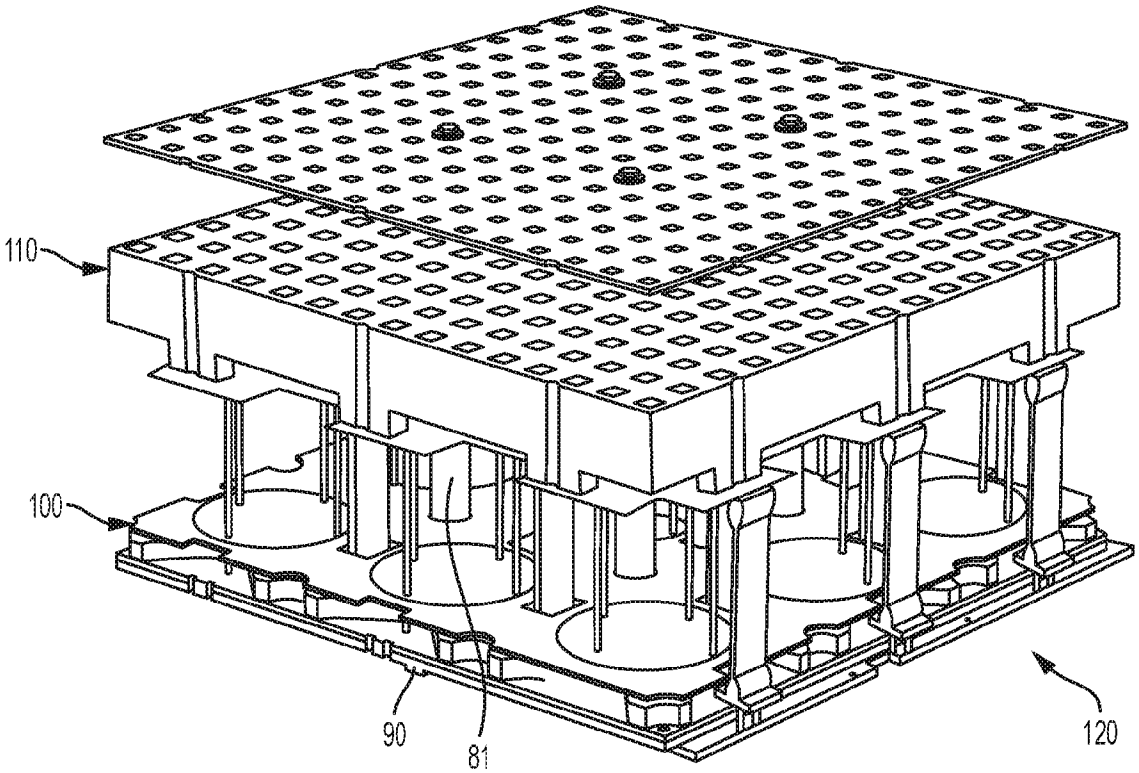
FIG. 9 is a perspective view of a final assembly of a complete subarray including the super cell assembly of FIGS. 5 and 6 and the super cell assembly of FIGS. 7 and 8.

With reference to FIG. 9, the M-WAIM super cell subassembly 110 is affixed or connected to the aperture super cell subassembly 100 to form a resulting super cell assembly 120 by the bolting of the second feed tower members 81 to the support plate 51 (see FIG. 1) of the horizontal ground plane assembly 90.

Figure 10:
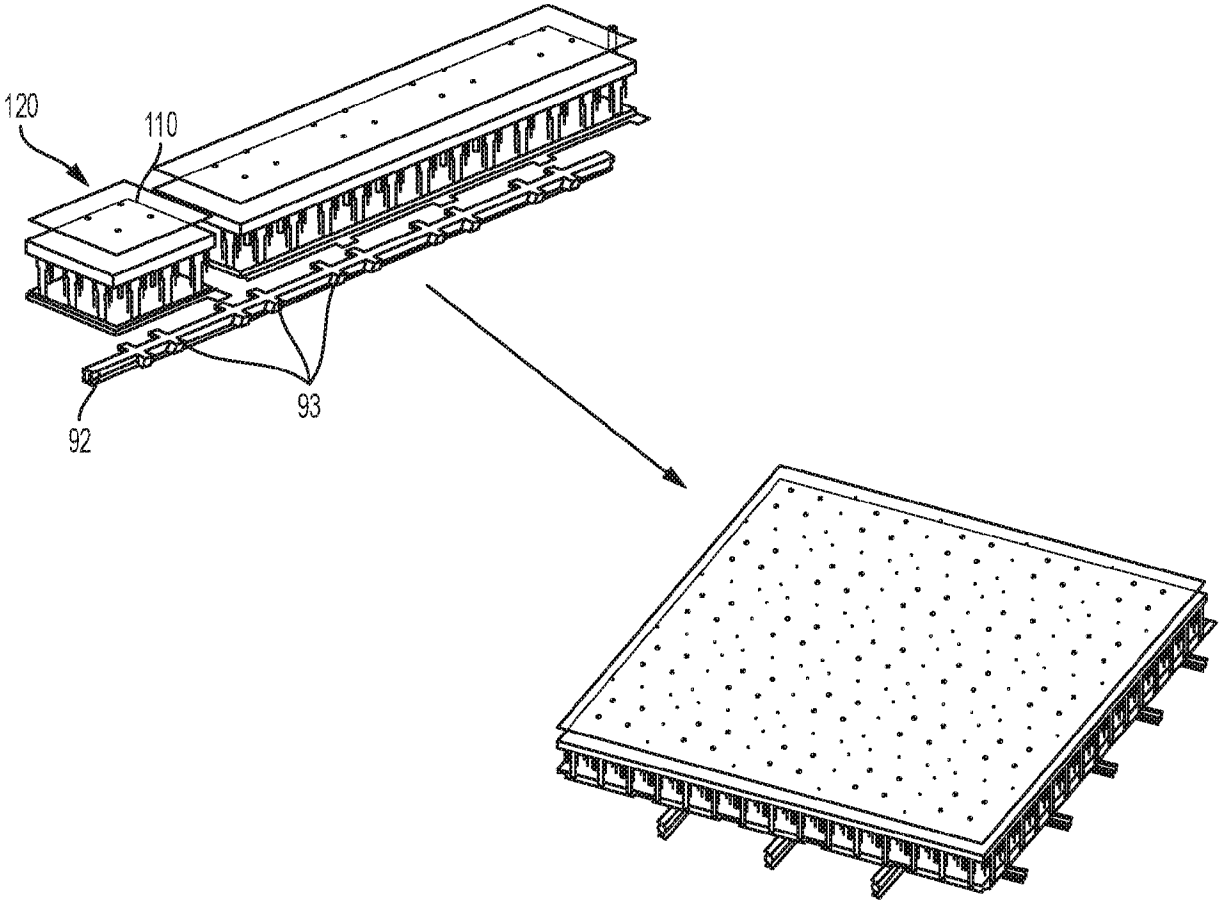
FIG. 10 is a perspective view of super cells of a phased array antenna in accordance with embodiments.

With reference to FIG. 10, super cell assemblies 120 are connectable with each other by way of the connective elements 91 (see FIG. 5). As shown in FIG. 10 and, in accordance with embodiments, guide bars 92 with connector bosses 93 may be provided in parallel or crisscrossing formations along respective sides of the super cell assemblies 120 to be connected. The connector bosses 93 are thus securely received in the connection openings 911 (see FIGS. 5 and 6) to thereby secure the corresponding super cell assembly 120 to the guide bar 92. In an exemplary case, a 15×15 element array that is 45"×45" may be built in this manner using 25 modular super cells 120 with each of the super cells 120 itself being a modular 3×3 array having 9 V-pol and 9H-pol elements.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the embodiments in the form disclosed. Many modifications and variations will be apparent to those of ordinary skill in the art without departing from the scope and spirit of the disclosure. The embodiments were chosen and described in order to best explain the principles of the disclosure and the practical application, and to enable others of ordinary skill in the art to understand the disclosure for various embodiments with various modifications as are suited to the particular use contemplated.

The flow depicted in FIGS. 5-9 is just one example. There may be many variations available that do not depart from the spirit of the disclosure. For instance, the steps may be performed in a differing order or steps may be added, deleted or modified. All of these variations are considered a part of the claimed embodiments.

What is claimed is:

1. An antenna, comprising:

a radiator assembly extending along a first plane;

a patterned ferrite layer extending along a second plane; and a band stop frequency selective surface (FSS) extending along a third plane, the third plane of the band stop FSS being axially interposed between the first plane of the radiator assembly and the second plane of the patterned ferrite layer.

2. The antenna according to claim 1, wherein the patterned ferrite layer and the band stop FSS are formed in accordance with a defined coincident phase center.

3. The antenna according to claim 1, further comprising:

a horizontal ground plane; and a feed, which is partially embedded within the horizontal ground plane and by which signals are delivered to the radiator assembly.

4. The antenna according to claim 1, wherein the radiator assembly comprises:

an aperture layer facing the band stop FSS;

first and second FSS superstrate structures; and a spatially engineered dielectric layer axially interposed between the aperture layer and the first and second FSS superstrate structures.

5. The antenna according to claim 4, further comprising feed tower members supporting the radiator assembly relative to at least the patterned ferrite layer and the band stop FSS.

6. The antenna according to claim 4, wherein the first and second FSS superstrate structures comprise etched conductors and are configured to provide a greater than 10:1 bandwidth ratio.

7. The antenna according to claim 1, wherein:

the patterned ferrite layer comprises a ferrous material arranged in an X-formation, and the band stop FSS comprises an annular conductor centered relative to the X-formation of the patterned ferrite layer.

8. A patterned ferrite layer of an antenna with dual linear polarization and a coincident phase center, the patterned ferrite layer comprising:

ferrous material, which is arranged in line with at least the coincident phase center, the ferrous material being formed to define openings offset from the coincident phase center.

9. The patterned ferrite layer according to claim 8, wherein the ferrous material is arranged in an X-formation with a crossing aligned with the coincident phase center.

10. A phased array antenna formed of a plurality of modular antenna cells, each of the modular antenna cells comprising:

a radiator assembly;

a patterned ferrite layer;

a band stop frequency selective surface (FSS) axially interposed between the radiator assembly and the patterned ferrite layer; and a ground plane assembly having connective elements arranged along a perimeter thereof for connection with complementary connective elements of adjacent antenna cells.

11. The phased array antenna according to claim 10, wherein the ground plane assembly is configured for connection to adjacent ground plane assemblies along at least one of four or more sides thereof.

12. The phased array antenna according to claim 10, wherein the patterned ferrite layer and the band stop FSS are formed in accordance with a defined coincident phase center.

13. The phased array antenna according to claim 10, wherein the ground plane assembly comprises:

a horizontal ground plane on which the patterned ferrite layer is disposed and about a perimeter of which the connective elements are arranged; and a feed, which is partially embedded within the horizontal ground plane and by which signals are delivered to the radiator assembly.

14. The phased array antenna according to claim 10, wherein the radiator assembly comprises:

an aperture printed wiring board (PWB) layer facing the band stop FSS;

first and second FSS superstrate structures; and a spatially engineered dielectric layer axially interposed between the aperture layer and the first and second FSS superstrate structures.

15. The phased array antenna according to claim 14, wherein the aperture PWB layer is disposed at an offset angle from the patterned ferrite layer.

16. The phased array antenna according to claim 14, wherein the radiator assembly further comprises:

vertical transmission line structures extending between ground plane assembly and the aperture PWB layer;

first feed tower members supporting the first FSS superstrate structure relative to the ground plane assembly; and second feed tower members supporting the second FSS superstrate structure relative to the ground plane assembly.

17. The phased array antenna according to claim 16, wherein the first and second feed towers comprise different materials.

18. The phased array antenna according to claim 14, wherein the first and second FSS superstrate structures comprise etched conductors and are configured to provide a greater than 10:1 bandwidth ratio.

19. The phased array antenna according to claim 10, wherein:

the patterned ferrite layer comprises a ferrous material arranged in an X-formation, and the band stop FSS comprises an annular conductor centered relative to the X-formation of the patterned ferrite layer.

20. The phase array antenna according to claim 19, wherein the X-formation of the patterned ferrite layer comprises crossing ferrite members disposed at an acute angle relative to the perimeter of the ground plane.

* * * * *